US006299257B1

(12) United States Patent
Constantino

(10) Patent No.: US 6,299,257 B1
(45) Date of Patent: Oct. 9, 2001

(54) MACHINE FOR REMOVING TILE WITH ARTICULATED FRAME

(76) Inventor: Alfred Constantino, 34 Mac Arthur Dr., Smithfield, RI (US) 02917

( * ) Notice: Subject to any disclaimer, the term of this patent is extended or adjusted under 35 U.S.C. 154(b) by 0 days.

(21) Appl. No.: 09/274,614

(22) Filed: Mar. 23, 1999

Related U.S. Application Data

(60) Provisional application No. 60/079,610, filed on Mar. 27, 1998.

(51) Int. Cl.[7] ..... A47L 13/02

(52) U.S. Cl. ..... 299/36.1; 15/93.1

(58) Field of Search ..... 37/270, 271; 15/93.1, 15/93.3; 172/779; 299/36.1, 37.1, 37.2, 76, 39.3, 39.6

(56) References Cited

U.S. PATENT DOCUMENTS

| | | | | |
|---|---|---|---|---|
| 2,468,336 | * | 4/1949 | Lewis | 299/39.3 |
| 2,906,514 | * | 9/1959 | Becker | 299/36.1 |
| 4,365,843 | | 12/1982 | Grasse | 299/37 |
| 4,504,093 | | 3/1985 | Grasse | 299/37 |
| 5,002,629 | | 3/1991 | Nakamura | 156/584 |
| 5,037,160 | | 8/1991 | Ukai | 299/37 |
| 5,082,330 | | 1/1992 | Holder | 299/37 |
| 5,197,784 | | 3/1993 | Holder | 299/37 |
| 5,641,206 | | 6/1997 | Craft | 299/37.1 |
| 5,772,284 | * | 6/1998 | Lindsey et al. | 299/36.1 |
| 5,830,313 | * | 11/1998 | Smith | 299/37.1 |

* cited by examiner

*Primary Examiner*—Thomas B. Will
*Assistant Examiner*—John Kreck
(74) *Attorney, Agent, or Firm*—Perman & Green, LLP

(57) ABSTRACT

A machine for scrapping surface materials from a floor having an articulated structure which allows the adjustment of the angle of the scraper blade by pivot motion of the main body element. A front wheel assembly is retractable to allow the blade to support the machine. A dual power mode is also provided.

10 Claims, 3 Drawing Sheets

MACHINE FOR REMOVING TILE WITH ARTICULATED FRAME

This is a provisional application No. 60/079,610, filed Mar. 27, 1998.

BACKGROUND OF THE INVENTION

In the renovation and repair of industrial buildings, such as factories and warehouses, it is often necessary to remove existing floor coverings. These floor coverings can be of a great variety of materials, such as rugs, wood, tile, etc. which are secured to a cement floor by high strength adhesive. The removal of such floor coverings is a labor intensive and difficult task. The machines currently available take the form of hand or motor driven scrapers which push a heavy duty scraping blade over the floor to raise the floor covering.

A machine of this type which is designed specifically for tile removal is described in U.S. Pat. No. 5,641,206. The machine of the '206 patent employs an hydraulic cylinder to raise and lower the blade into engagement with the floor. The force distribution requires supplemental weights at the front and back of the machine to increase the force response of the blade and to insure proper traction on the rear wheel. Such machines do not perform efficiently, thereby requiring repetitive passes over the floor.

It is the purpose of this invention to improve the performance of a tile scrapping machine and the overall operation of such machines.

SUMMARY OF THE INVENTION

A machine is designed having a frame articulated along a pivot axis displaced a short distance forward of the wheel axis. The frame consists of a main body and a rear portion. The main body is constructed with an integral blade mounting bracket welded to its forward end. A forward support wheel is mounted for vertical movement on the main body just rearward of the blade. An hydraulic piston is operatively connected to the support wheel to retract the wheel during operation of the scrapper.

The rear frame portion is constructed with a pair of flanges having means to attach the axle for the rear wheels. The flanges extend a short distance both forward and rearward of the axis of the wheels. The main body is pivotally attached to the rear flanges by means of a horizontally extending cylindrical bar just forward of the drive wheel axis. A transverse beam connects the two flanges just behind the axis of the drive wheels. In order to adjust the angle of the blade a second hydraulic cylinder is connected to the transverse beam to exert a moment force on the rear frame portion to pivot the flanges about the wheel axis and thereby raise the rear of the main body.

The main body encloses a reservoir for hydraulic fluid which is pumped to independent drive pumps operatively connected to each wheel. In addition the same fluid is used to operate the front wheel retraction cylinder and the rear blade height adjustment cylinder. A drive pressure is obtained from main drive pumps which may be operated either by a piston engine powered by propane or an electrical motor each being mounted on the main body.

DESCRIPTION OF THE DRAWING

The invention of this application is described in more detail below with reference to the Drawing in which.

DESCRIPTION OF THE PREFERRED EMBODIMENT

Figure 1:
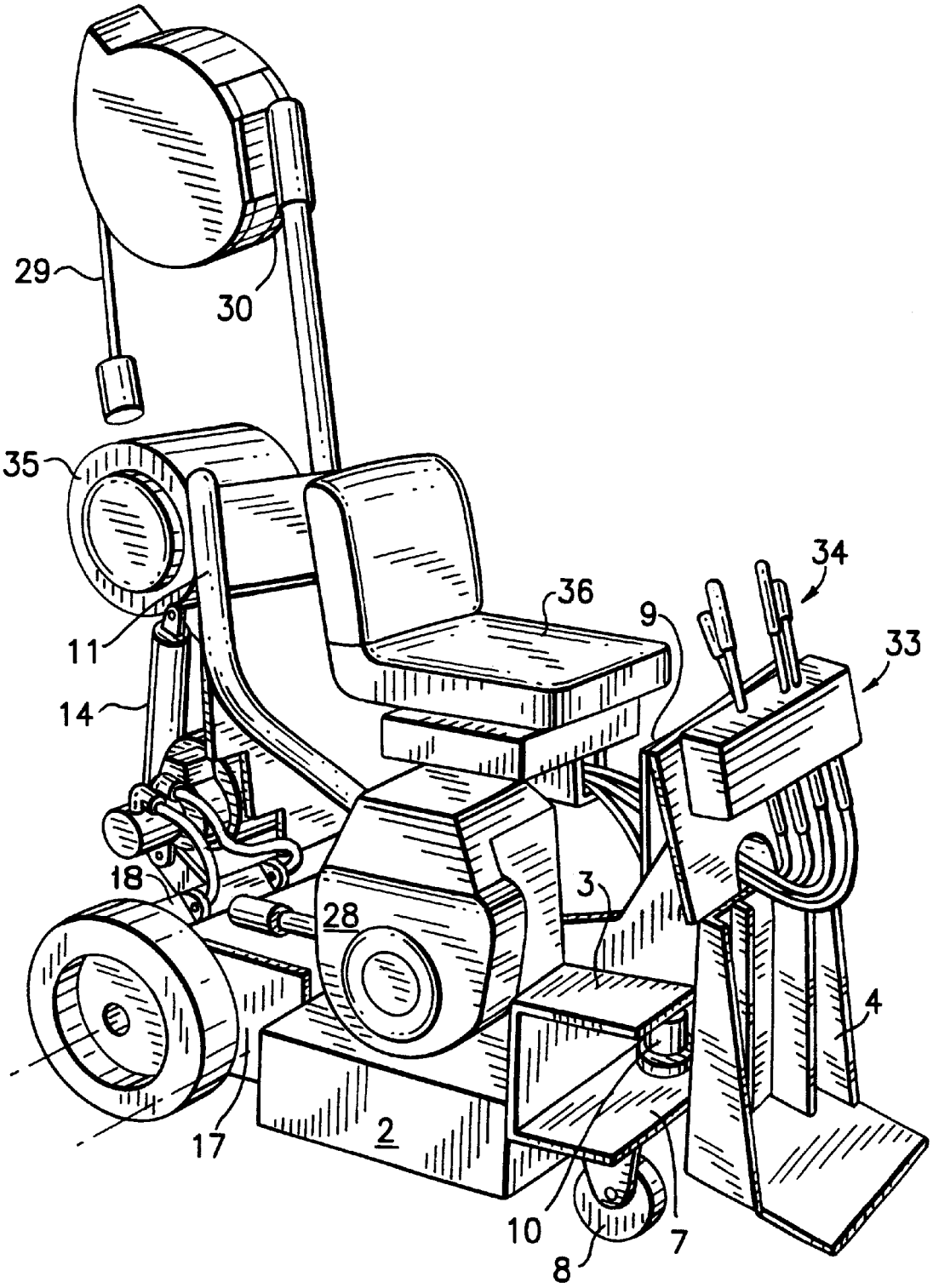
FIG. 1 is a front perspective view of a machine employing the features of this invention.

Referring to the figures, the machine of this invention includes a high strength blade element 6 mounted for engagement with the floor to scrape and remove surface materials. The machine consists of a frame 1 constructed in two primary sections, a main body 2 and a rear flange assembly 21. Body 2 extends forward from the wheels 22 in a substantially horizontal attitude in the non-operational condition, i.e., blade 6 raised above the floor. Body 2 is comprised of a rear pivot support extension 16, a forward mounting beam 3 and a blade mounting bracket 4. The assembly of elements comprising the body 2 are welded together to form a rigid support element for the machine. A heavy duty scrapper blade 6 is mounted on the bracket 4 through an optional wedge 5.

A support castor 8 is mounted on an angle iron 7 which in turn is mounted on the actuating shaft 10 of an hydraulic cylinder 9. The castor support assembly is therefore retractable upon operation of cylinder 9. The body 2 encloses an interior reservoir 23 which is filled with hydraulic fluid through spout 12 which is closed by cap 13.

The rear flange assembly 21 consists of side flanges 17 connected by transverse beam 18 to form a support frame for the axle and wheels 22. The transverse beam 18 is welded at its ends to each of the flanges 17 to form an integral assembly. The side flanges 17 extend, both forward and rearward, a short distance from the wheel axle 20. At their forward end, the flanges are pivotally connected to a pivot bar 40, which is pivotally mounted on the support extensions 16 of the body 2. In this manner the assembly of body 2 and rear frame 21 form an articulated assembly which pivot about a horizontal axis B just forward of the rotational axis A of the drive wheels 22, as shown by arrows 37 and 38.

A vertical frame member 11 extends upward from the body 2 to support a variety of machine elements described below. An hydraulic cylinder 14 having an actuating shaft 15 is connected between the body 2 and the rear frame 21 at the vertical frame member 11 and the transverse beam 18, respectively. Actuation of the cylinder 14 will extend the actuating shaft 15, thereby exerting a moment force on the rear of frame 21, as illustrated by arrow 39. This force will tend to raise the forward portion of frame 21 with the rear portion of the body 2 and adjust the operational angle $\Phi$ of the blade 6.

Figure 2:
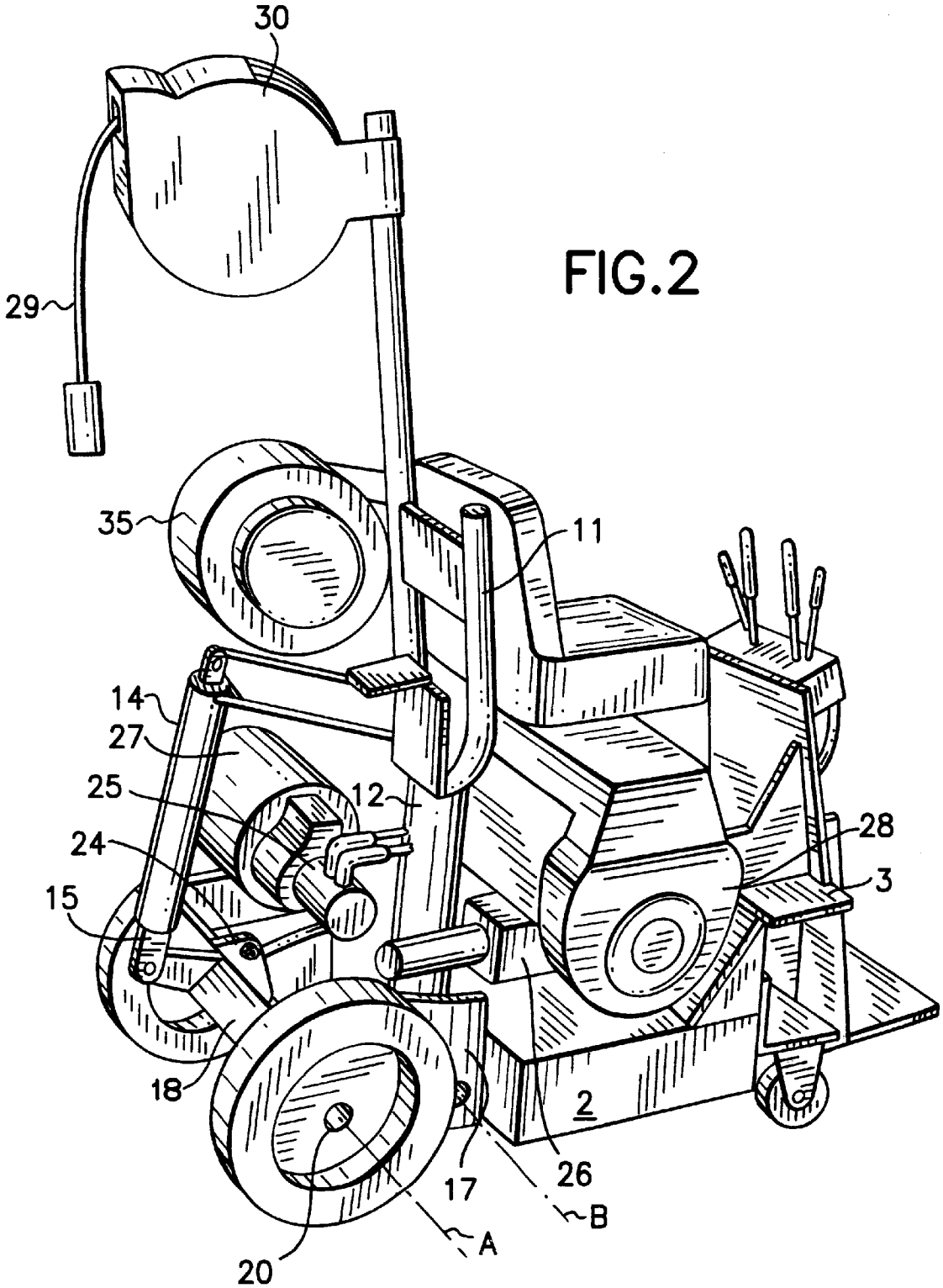
FIG. 2 is a rear perspective view of a machine employing the features of this invention.
Figure 3:
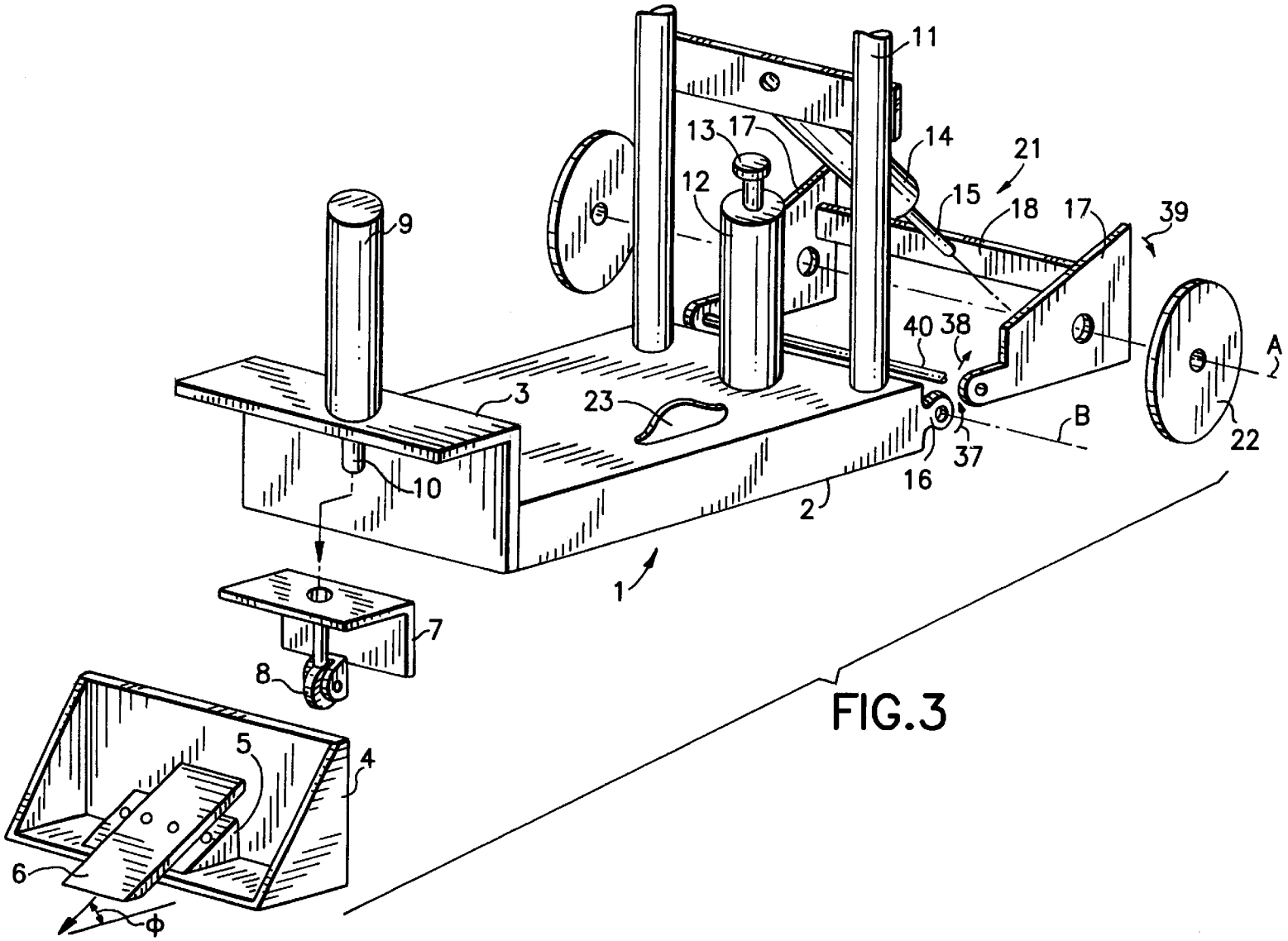
FIG. 3 is an exploded perspective view of the frame of this invention.

As shown in FIGS. 1 and 2 each of the pair of wheels 22 are independently driven by drive pumps 24. The drive pumps 24 are supplied by main pressure pumps 25 and 26. Pump 25 is driven by an electrical motor 27 mounted on vertical frame 11. Pump 26 is driven by piston engine 28. An electrical supply is connected to electric motor 27 through conduit 29 contained on reel 30. Reel 30 is mounted on a retractable extension 31 of the vertical frame 11. A source of propane, tank 35, is mounted on the vertical frame 11 to power the piston engine 26.

The hydraulic components are connected through a system of conduits 32 and controlled by a series of control valves 33 operated by manual levers 34.

The operator sits on the seat 36 mounted on the vertical frame 11 within easy reach of the manual levers 34. The height of the seat is adjusted to provide the operator with a clear view of the blade 6 during operation.

In operation the source of power is selected, either electrical or propane, and energized. Through the actuation of cylinder 9, the wheel 8 is retracted to allow the full weight of the machine to be supported on blade 6. The blade 6 will engage the surface of the floor along an angle Φ and exert a force indicated by force vector F as the drive wheels 22 are driven forward. The angle Φ of force vector F is adjustable through the actuation of cylinder 14. Depending on the difficulty of the removal operation, the width of the blade may be varied, a narrower blade being used for more difficult tasks. Through the independent drive mechanisms, the rotation of the wheels may be relatively adjusted to steer the machine across the work area.

I claim:

1. A machine for scraping surface materials from a floor, said machine having a front wheel assembly and a rear wheel assembly, said machine comprising;

a main body, forming a support structure for the machine, extending between said front wheel assembly and said rear wheel assembly, said main body having front and rear portions moveably interconnected for relative motion about a first axis, said first axis being transverse to a longitudinal axis of the machine and positioned between said front a rear wheel assemblies;

positioned rearward of said first axis, said rear portion having an extension projecting rearward of said second axis;

said front portion having said front wheel assembly mounted forward of said first axis and having a scrapper blade mounted thereon forward of said front wheel assembly for engaging the surface materials at an angle, said scrapper and said front wheel assembly mounted such that the front wheel assembly will not contact the floor while the machine is scraping; and an actuator operatively connected to said extension of said rear frame to pivot the rear frame about said second axis to adjust the angle of engagement of the scrapper blade.

2. A machine for scraping surface materials from a floor, as described in claim 1, wherein the front wheel assembly is mounted on the main body for vertical movement into and out of engagement with the floor and further wherein in an extended position said wheel assembly raises the scrapper blade up and disengages said blade from the floor to facilitate movement of the machine.

3. A machine for scraping surface materials from a floor, as described in claim 2, wherein the front wheel assembly is mounted on the actuator shaft of an hydraulic piston, said piston mounted on the main body for vertical movement of the actuator shaft.

4. A machine for scraping surface materials from a floor, as described in claim 1, wherein one of said wheel assemblies includes a pair of wheels operatively attached to a drive system, and wherein said drive system further comprises first and second drive elements connected independently to each of the wheels of said pair of wheels to rotate the wheels and provide movement of the machine.

5. A machine for scraping surface materials from a floor, as described in claim 4 wherein the drive elements comprise hydraulic motors which are driven by an hydraulic pressure system.

6. A machine for scraping surface materials from a floor, as described in claim 5, wherein the main body is constructed to house a reservoir for a supply of hydraulic fluid for the hydraulic pressure system.

7. A machine for scraping surface materials from a floor, as described in claim 5, wherein the hydraulic pressure system is operatively connected to a power system wherein said power system comprises both an electric motor and a gas powered piston engine to provide alternative means for powering the hydraulic pressure system.

8. A machine for scraping surface materials from a floor, said machine having a front wheel assembly and a rear wheel assembly, as described in claim 1, wherein said rear wheel assembly includes a pair of wheels operatively attached to a drive system, and wherein said drive system further comprises first and second hydraulic motors connected independently to each of the wheels of said pair of wheels to rotate the wheels and provide movement of the machine, said hydraulic motors driven by an hydraulic pressure system; and a second actuator having a moveable shaft extending therefrom, wherein the front wheel assembly is mounted on said shaft of said second actuator, said actuator mounted on the main body for vertical movement of said shaft to move said front wheel assembly into and out of engagement with the floor and further wherein, in an extended position, said wheel assembly raises the scrapper blade up and disengages said blade from the floor to facilitate movement of the machine.

9. A machine for scraping surface materials from a floor, as described in claim 8, wherein the first and second actuators are hydraulic cylinders driven by said hydraulic pressure system.

10. A machine for scraping surface materials from a floor, as described in claim 8, wherein the main body is constructed to house a reservoir for a supply of hydraulic fluid for the hydraulic pressure system.

* * * * *

UNITED STATES PATENT AND TRADEMARK OFFICE

CERTIFICATE OF CORRECTION

PATENT NO. : 6,299,257 B1
DATED : October 9, 2001
INVENTOR(S) : Costantino

It is certified that error appears in the above-identified patent and that said Letters Patent is hereby corrected as shown below:

Title page,
Item [76], inventors name should read -- Alfred Costantino --.

Column 3,
Line 25, before "positioned rearward" insert -- said rear portion constructed to receive the rear wheel assembly for rotation thereon about a second axis, said second axis being --.

Signed and Sealed this

Twenty-fourth Day of September, 2002

*Attest:*

*Attesting Officer*

JAMES E. ROGAN
*Director of the United States Patent and Trademark Office*